US011638489B2

(12) United States Patent
Cohen

(10) Patent No.: US 11,638,489 B2
(45) Date of Patent: May 2, 2023

(54) APPARATUS AND METHOD FOR A DROP TRAY

(71) Applicant: CATCHY BABY IP PTY LTD, Rose Bay (AU)

(72) Inventor: Bradley Cohen, Rose Bay (AU)

(73) Assignee: CATCHY BABY IP PTY LTD, Sydney (AU)

( * ) Notice: Subject to any disclaimer, the term of this patent is extended or adjusted under 35 U.S.C. 154(b) by 0 days.

(21) Appl. No.: 17/933,825

(22) Filed: Sep. 20, 2022

(65) Prior Publication Data

US 2023/0031494 A1 Feb. 2, 2023

Related U.S. Application Data

(63) Continuation of application No. PCT/IB2022/053331, filed on Apr. 8, 2022.

(30) Foreign Application Priority Data

Apr. 11, 2021 (AU) ..... 2021/901051

(51) Int. Cl.
*A47D 1/00* (2006.01)
*A47D 15/00* (2006.01)
*B65D 5/30* (2006.01)

(52) U.S. Cl.
CPC ..... *A47D 1/0081* (2017.05); *B65D 5/302* (2013.01)

(58) Field of Classification Search
CPC ..... A47D 15/00; A47D 1/0081
(Continued)

(56) References Cited

U.S. PATENT DOCUMENTS 837,570 A 12/1906 Jackson et al.
924,554 A 6/1909 Jackson et al.
(Continued)

FOREIGN PATENT DOCUMENTS

DE 202017004770 U1 9/2017
EP 687631 A1 12/1995
WO 2022219480 A1 10/2022

OTHER PUBLICATIONS

Notification of Transmittal of the International Search Report and the Written Opinion of the International Searching Authority, or the Declaration dated Jul. 7, 2022, for corresponding application No. PCT/IB2022/053331, filed Apr. 8, 2022. (2 pgs.).
(Continued)

*Primary Examiner* — Sarah B McPartlin
(74) *Attorney, Agent, or Firm* — Finnegan, Henderson, Farabow, Garrett & Dunner, L.L.P.

(57) ABSTRACT

An apparatus and method for catching spills are disclosed. The apparatus comprises a drop tray and a high-chair including one or more legs and a high-chair seat. The apparatus further comprises the one or more legs that may be connected to the high-chair where one or more legs may raise the high-chair seat above a floor. Moreover, the apparatus comprises the drop tray that may be disposed above the floor and underneath the high-chair seat. The drop tray may surround the one or more legs of the high-chair where the drop tray may include an upper peripheral edge above and surrounding a base. Furthermore, the drop tray may include one or more sidewalls extending between the upper peripheral edge and the base. Moreover, the base may affixed to the one or more legs of the high-chair.

22 Claims, 12 Drawing Sheets

900

(58) Field of Classification Search
USPC ..... 297/188.08
See application file for complete search history.

(56) References Cited

U.S. PATENT DOCUMENTS

| | | | | |
|---|---|---|---|---|
| 1,959,613 | A | 5/1934 | Carson | |
| 2,585,434 | A * | 2/1952 | Caponera | A47G 27/0206 297/182 |
| 2,938,574 | A * | 5/1960 | Brown | A47D 15/00 297/182 |
| 3,128,137 | A * | 4/1964 | Dokter | A01K 97/06 206/315.11 |
| 3,298,736 | A | 1/1967 | Decker | |
| 3,536,248 | A | 10/1970 | Odenhagen et al. | |
| D249,022 | S | 8/1978 | Bamburg et al. | |
| D255,780 | S | 7/1980 | Kuplis | |
| 4,295,839 | A | 10/1981 | Baker et al. | |
| D261,618 | S | 11/1981 | Oliff et al. | |
| 4,574,977 | A | 3/1986 | Ellis et al. | |
| D296,747 | S | 7/1988 | Johnson | |
| 4,940,620 | A | 7/1990 | Silk et al. | |
| D311,336 | S | 10/1990 | Haraldsson | |
| D312,213 | S | 11/1990 | Forbes, Jr. | |
| 5,211,607 | A * | 5/1993 | Fermaglish | A47D 3/005 297/137 |
| D440,826 | S | 4/2001 | Quaintance | |
| 6,505,769 | B2 | 1/2003 | Stone | |
| 6,652,947 | B2 | 11/2003 | Sweeney et al. | |
| D519,838 | S | 5/2006 | Brooks | |
| D600,550 | S | 9/2009 | King | |
| D603,255 | S | 11/2009 | King | |
| D637,078 | S | 5/2011 | Peng | |
| 8,807,648 | B2 * | 8/2014 | Carroll | A47C 7/62 297/188.21 |
| 9,084,495 | B2 * | 7/2015 | Ing | A47D 1/00 |
| D775,947 | S | 1/2017 | Epstein et al. | |
| 2006/0261646 | A1 * | 11/2006 | McGuire | A47C 7/62 297/188.08 |
| 2010/0013277 | A1 | 1/2010 | O'Toole | |
| 2011/0043012 | A1 | 2/2011 | Werner | |
| 2011/0074187 | A1 | 3/2011 | Zhong | |
| 2012/0104193 | A1 | 5/2012 | Cheng | |
| 2012/0286546 | A1 | 11/2012 | Ballard et al. | |
| 2015/0320234 | A1 | 11/2015 | Ing et al. | |
| 2020/0245779 | A1 | 4/2020 | Robinson | |

OTHER PUBLICATIONS

Written Opinion ofthe International Searching Authority, dated Jul. 7, 2022, for corresponding application No. PCT/IB2022/053331, filed Apr. 8, 2022. (6 pgs.).

International Search Report dated Jul. 7, 2022, for corresponding application No. PCT/IB2022/053331, filed Apr. 8, 2022. (2 pgs.).

International-type Search Report from the Australian Patent Office dated Aug. 16, 2021 for corresponding application No. 2021901051, filed Apr. 11, 2021.

High Chair Catchy, <URL: https://www.facebook.com/highchaircatchy/videos/wonderinghow-to-set-up-catchy-its-easy-as-1%EF%B8%8F%E2%83%A3-2%EF%B8%8F%E2%83%A3-3%EF%B8%8F%E2%83%A3-/161597392218054/ > Published on Nov. 21, 2020.

Catchy—The Baby High Chair Food Catcher, <URL: https://www.facebook.com/highchaircatchy/videos/catchy-thebaby-high-chair-food-catcher/628820424685466/ > Published on Aug. 6, 2020.

https://web.archive.org/web/20210228115754/https:/highchaircatchy.com/> published on Feb. 28, 2021 as per Wayback Machine.

Mumma's Little Helpers, <URL: https://www.facebook.com/Mummaslittlehelpers/videos/the-highchair-food-catcher-attaches-to-any-4-leg-high-chairwaterproof-andmachi/1456838041092164/> Published on Mar. 6, 2018.

https://www.amazon.com/Washable-Highchairs-Waterproof-Anti-Slip-Playtime/dp/B08JZ2TN55/ref=asc_df_B08JZ2TN55/?tag=hyprod-20&linkCode=df0&hvadid=343269706313&hvpos=&hvnetw=g&hvrand=13258002846303508592&hvpone=&hvptwo=&hvqmt=&hvdev=c&hvdvcmdl=&hvlocint=&hvlocphy=1014895&hvtargid=pla-988636848239&psc=1&tag=&ref=&adgrpid=68249716559&hvpone=&hvptwo=&hvadid=343269706313&hvpos=&hvnetw=g&hvrand=13258002846303508592&hvqmt=&hvdev=c&hvdvcmdl=&hvlocint=&hvlocphy=1014895&hvtargid=pla-988636848239.

https://www.lowes.com/pl/Washing-machine-drip-pan--Washer-parts-Appliance-parts-accessories-Appliances/4171085089?cm_mmc=src-_-c-_-prd-_-app-_-ggl-_-NB_APP_174_Laundry-_-washing%20machine%20tray-_-0-_-0-_-0&gclid=CjwKCAjw8sCRBhA6EiwA6_IF4TfPbzbcxXi5v2jKIQzsshdmdMHxdNfcj0jnwJuPAvetfXgD6nWxZRoCG-0QAvD_BwE&gclsrc=aw.ds&refinement=2753178105.

https://www.kidzkatch.com/gallery.

https://www.kidzkatch.com/.

https://mummaslittlehelpers.com.au/.

https://www.evenflo.com/products/eat-n-grow-high-chair.

* cited by examiner

400

APPARATUS AND METHOD FOR A DROP TRAY

CROSS REFERENCE TO RELATED APPLICATION

This is a continuation application of International Application No. PCT/IB2022/053331, filed Apr. 8, 2022, which claims the benefit of priority from Australian Provisional Application No. 2021/901051, filed Apr. 11, 2021, all of which are herein incorporated by reference in their entireties.

TECHNICAL FIELD

Embodiments of the present disclosure relate to an apparatus and method for a drop tray used to catch falling debris and in particular but not limited to debris dropped by an infant while seated in a high-chair, including food and liquids.

BACKGROUND

Inclusion herein of any prior art or background discussion should not be taken as admission that any matter discussed, including problems identified and solved by the Applicant, were known to anyone apart from the Applicant, were public knowledge or common general knowledge anywhere.

Conventional high-chairs have four splayed legs, a seat, leg holes and some form of restraint or upper section formed with rails and usually a front table section.

Food, liquids, utensils, or plates may often drop or spill on the floor. Infants may be very messy in fun and in temper. The usual solution may be to provide a drop sheet or mat on the floor, the chair may be placed on top of the mat which may have sufficient margin around the chair to cater for the range of falling debris from the infant's activity. If one wants to move the chair, the mat must be moved separately with the chair where the mat may already be in a mess. Quite often baby food may not be that appealing so the mat may have to be cleaned before it can be moved. Movement of the mat may cause more mess. Moving the chair and the mat separately may create additional work for parents.

It would be desirable to provide a useful alternative particularly, a drop tray, that may be moved with the chair and that may be simple to install, easy to clean, and inexpensive.

SUMMARY

Embodiments of the present invention provide a high-chair drop tray having an upper peripheral edge above and surrounding a base, a sidewall extending between the peripheral edge and the base, the base having means defining spaced apart openings for spaced high-chair legs.

Preferably, the tray is made from a blank of thin sheet plastics, the blank having a periphery corresponding to said peripheral edge, a base section inward of the periphery and corresponding to the base, the base section having means defining spaced apart openings preferably leg holes, there being a margin between the base section and the periphery, the margin corresponding to the sidewall, and there further being at least one joiner section adapted to engage and at the same time bias the sidewall to its operative position.

In one embodiment the tray is for use with a high-chair having four splayed legs extending from a seat region of the chair to the ends of the legs, the ends of opposed pairs of said legs being diametrically opposed at a leg end spacing between the opposed ends wherein the means defining spaced apart openings provide four leg holes as pairs of diametrically opposed holes corresponding to the legs of the chair, the spacing between the opposed leg holes being less than the said leg end spacing.

In another embodiment the tray is for use with a chair having two legs or uprights and in this case the means defining spaced apart openings provide two spaced slots for spaced apart square profile chair uprights or legs.

Where in one embodiment, the tray may be formed from a single material comprising a sidewall section pulled behind an adjacent wall section and having a releasable hand insertable catch to secure the wall sections together.

Where, in yet another embodiment, the tray may be formed by use of a joiner the joiner comprises a sidewall section pulled behind an adjacent wall section and having a releasable hand insertable catch to secure the wall sections together.

While the tray may have any shape suited to capturing dropped food it is preferred that the tray may generally be dished with a sloping sidewall defining an upper mouth wider than the base, typically it may be boxy in form. Where, in another embodiment, thin plastic may be used, and the sidewall may preferably be configured to be manually and usefully deformable and springs back to its operative position. It may be pulled to aid clearing or removing food from the tray.

While the means defining spaced apart openings may be cut openings they may be any form including but not limited to actual holes in the sense of closed loop, slots, sideway entry passages, clip in arrangements or means that may be formed into these including pushouts in the base.

BRIEF DESCRIPTION OF THE DRAWINGS

The accompanying drawings, which are incorporated in and constitute a part of this specification, illustrate several embodiments and, together with the description, explain the disclosed principles. In the drawings.

DETAILED DESCRIPTION

Figure 1:
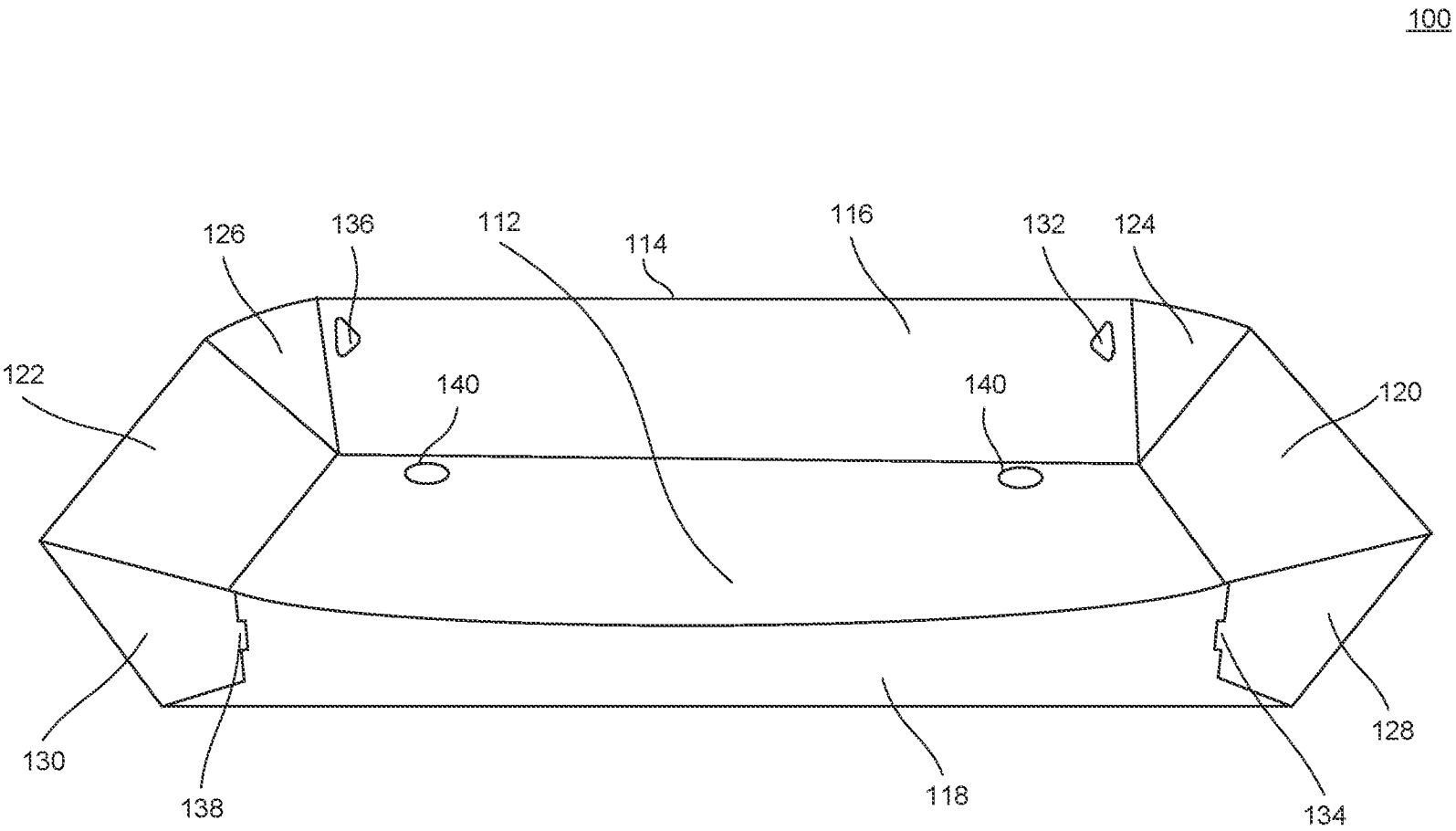
FIG. 1 is an exemplary illustration of a drop tray with openings, consistent with some embodiments of the present disclosure.

The following detailed description refers to the accompanying drawings. Wherever possible, the same reference numbers are used in the drawings and the following description to refer to the same or similar parts. While several illustrative embodiments are described herein, modifications, adaptations, and other implementations are possible. For example, substitutions, additions, or modifications may be made to the components and steps illustrated in the drawings, and the illustrative methods described herein may be modified by substituting, reordering, removing, or adding steps to the disclosed methods. Accordingly, the following detailed description is not limited to the disclosed embodiments and examples. Embodiments consistent with the present disclosure relate to a drop tray that may be a removable attachment to childrens' high-chairs to catch food mess or liquid spills, utensils, plates, and other debris dropped from the high-chair. The drop tray may be used with a high-chair where the high-chair may have one or more legs and a high-chair seat where a child may be placed upon. The drop tray may directly interface with or attach underneath the high-chair—immediately below the seat of the high-chair—without interfacing with one or more legs of the high-chair. The attachment or interface of the drop tray may include clipping, snapping, plugging, and/or integrating with a footrest, a car seat, a chair, a booster seat, or any other functionally similar devices for children. The drop tray may be disposed between the floor and the bottom of the high-chair seat where the drop tray is raised above the floor. The drop tray, disposed underneath the high-chair seat and above the floor, may have a surface area that encompasses and surrounds the bottom of the high-chair and/or the high-chair seat. The surface area of the drop tray may also extend and surround in all directions the high-chair where the drop tray may catch food mess or liquid spills, utensils, plates, and other debris dropped by an infant or child from the high-chair. The attachment (also including one or more legs) of the drop tray may also act as a footrest for the child. The drop tray may be a single material with one or more pieces joined and inseparable to a common piece where the one or more pieces may fold into themselves using deformable tab clips to create a secured and stable drop tray with raised walls and may attach to a high-chair, a footrest, a car seat, a chair, a booster seat, or any other functionally similar devices for children. The drop tray may also be one or more pieces separately connected together to fold unto themselves using deformable tab clips to create a secured, stable, and/or rigid drop tray with raised walls and may attach to a high-chair, a footrest, a car seat, a chair, a booster seat, or any other functionally similar devices for children. The drop tray may be a single apparatus made from a continuous single material with a base and raised walls and may attach to a high-chair, a footrest, a car seat, a chair, a booster seat, or any other functionally similar devices for children. The drop tray may be snuggly secured to or resting below a high-chair seat, a footrest, a car seat, a chair, a booster seat, or any other functionally similar devices by way of specifically placed holes or interfaces in which the high-chair frame may slot through or interface with the drop tray. The placed holes or interfaces may prevent food mess or liquid spills, utensils, and other debris dropped by an infant or child from the high-chair from falling to the floor. The drop tray may be used on high-chairs with or without feeding trays or footrests, or any other functionally similar devices for children. The drop tray may be made from waterproof and food safe materials. Moreover, the drop tray may be made from a food grade plastic material, thermoplastic material, thermoset material, injection molded plastics, silicone, or other material that may be deformable, molded, thermoformed, and/or dishwasher safe. The drop tray being thermoformed may mean that the drop tray may be made from a continuous single material without need of assembling parts of the drop tray. The thermoforming process may include any other similar manufacturing or plastic forming or molding process such as injection molding, silicone molding, polyurethane foam (PUR foam) molding, and/or any other functionally similar processes that would be apparent to those of ordinary skill in the art.

Generally, childrens' high-chairs may be composed of a high-chair frame, a seat, and a feeding tray. The seat may be for babies to sit on. The feeding tray may be used to put bowls, bottles, utensils, dishes or food.

Conventional high-chairs may not include a tray catching food or liquid spills, utensils, plates, and other debris dropped from the high-chair. Thus as a child may eat, food and utensils commonly spill or fall from the tray, front, sides and rear of the high-chair or from between the leg compartment of the high-chair, onto the floor.

The drop tray may catch the food or liquid spills, plates, or utensils so that the food may be salvaged or thrown away, the spills may be disposed, the utensils or plates may be reused, while protecting the floor below the high-chair from damage or dirty debris. The drop tray may also ensure that food and utensils may be retrieved from the drop tray at an appropriate height to ensure that guardians feeding the baby and helping to clean up during and after mealtimes may not have to repeatedly bend down to low uncomfortable positions. The raised height of the drop tray may also act as a footrest so that during meal times, the feet of a baby may be resting and not dangling in a way that may feel unsteady and uncomfortable.

FIG. 1 is an exemplary illustration of a drop tray with openings, consistent with some embodiments of the present disclosure. As illustrated in FIG. 1, a drop tray 100 with openings may comprise a base with raised sidewalls and an open top. The drop tray 100 may include a base 112 and a plurality of upper peripheral edges 114 positioned above and surrounding the base 112 to form an open top where the base 112 may be connected to the plurality of peripheral edges 114 by a plurality of raised sidewalls extending from the base 112 to the plurality of peripheral edges 114.

The plurality of raised sidewalls may include a first sidewall 116, a second sidewall 118, a third sidewall 120, and a fourth sidewall 122. The first sidewall 116 may be equal in dimensions and shape as the second sidewall 118. The first sidewall 116 may be positioned in a parallel and opposite location of the second sidewall 118 relative of the base 112. The third sidewall 120 may be equal in dimensions and shape as the fourth sidewall 122, The third sidewall 120 may be positioned in a parallel and opposite location of the fourth sidewall 122 relative of the base 112. The first sidewall 116 may not be equal in dimensions and shape as the third sidewall 120. In other embodiment, the first sidewall 116, the second sidewall 118, the third sidewall 120, and the fourth sidewall 122 may be equal in dimensions and shape.

The plurality of raised sidewalls and the base 112 may each be in the shape of a square, a rectangle, a circle, a triangle, an oval, and/or any combination thereof. Furthermore, the plurality of raised sidewalls may also include a first corner sidewall 124 and a second sidewall 126 that may appear to have a triangular shape, an oval shape, a circular shape, a rectangular shape, a trapezoidal shape, a round shape, or a square shape. The first corner sidewall 124 may be connected to the first sidewall 116, the third sidewall 120, and the base 112. The second corner sidewall 126 may be connected to the first sidewall 116, the fourth sidewall 122, and the base 112. Moreover, the plurality of raised sidewalls may also include a third corner sidewall 128 and fourth corner sidewall 130 that may appear to have a trapezoidal shape. The third corner sidewall 128 may be connected to the second sidewall 118, the third sidewall 120, and the base 112. The fourth corner sidewall 130 may be connected to the second sidewall 118, the fourth sidewall 122, and the base 112.

Furthermore, the first corner sidewall 124 and the third corner 128 may each share an edge with the third sidewall 120 having a direct connection with the third sidewall 120. Moreover, the first corner sidewall 124 may include a deformable tab clip 132 where the deformable tab clip 132 may be inserted on approximately the upper corner surface of the first sidewall 116 via a deformable slit opening. Similarly, the third corner sidewall 128 may include a deformable tab clip 134 where the deformable tab clip 134 may be inserted on approximately the upper corner surface of the second sidewall 118.

Moreover, the second corner sidewall 126 and the fourth corner 130 may each share an edge with the fourth sidewall 122 having a direct connection with the fourth sidewall 122. Moreover, the second corner sidewall 126 may include a deformable tab clip 136 where the deformable tab clip 136 may be inserted on approximately the upper corner surface of the first sidewall 116 via a deformable slit opening. Similarly, the fourth corner sidewall 130 may include a deformable tab clip 138 where the deformable tab clip 138 may be inserted on approximately the upper corner surface of the second sidewall 118. The deformable tab clip 132, 134, 136, and 138 may be in the shape of a triangle, a circle, a rectangle, a trapezoid, an oval, a spade, an arrowhead, and/or any combination thereof.

The base 112 may include one or more openings 140 to interface or accommodate a high-chair's legs or stands, a footrest, a car seat, or any other functionally similar devices for children. The base 112 may be affixed to the high-chair's legs or stands, a footrest, a car seat, or any other functionally similar devices for children. The one or more openings 140 may each be in the shape of a square, a rectangle, an oval, a circle, a triangle, a star, and/or any combination thereof. The one or more openings 140 may be approximately placed near the corners, the edges, and/or the center of the base 112. In one embodiment, the one or more openings 140 may be four circles approximately placed at the corners of the base 112. The one or more openings may have a local surface area that may be raised above and connected to the surface of the base 112 to prevent food or liquid spills, utensils, plates, and other debris dropped by an infant from the high-chair to slip through the high-chair's legs or stands, the interface of the footrest, the interface of the car seat, or the interface of any other functionally similar devices for children. An opening may be in the shape of a square, a rectangle, an oval, a circle, a triangle, a star, and/or any combination thereof.

In another embodiment, base 112 may have in place of the one or more openings 140 one or more legs where the drop tray 100 may stand on its own below a high-chair a footrest, a chair, a booster seat, or any other functionally similar devices for children.

In yet another embodiment, the one or more openings 140 may be placed on the plurality of raised sidewalk instead of the base 112 where the one or more openings 140 may interface or accommodate a high-chair's legs or stands, a footrest, a car seat, or any other functionally similar devices for children.

Figure 2:
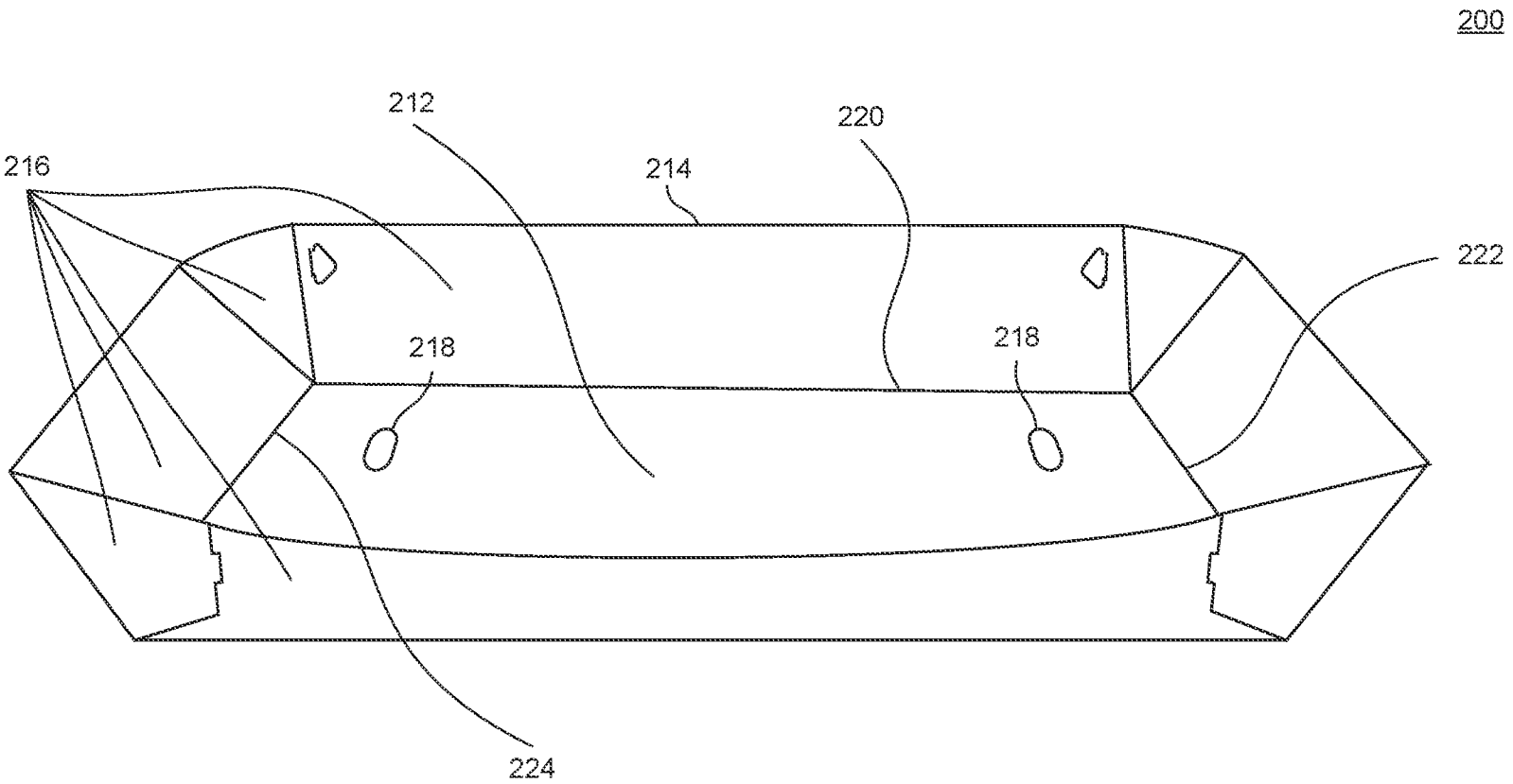
FIG. 2 is an exemplary illustration of a drop tray with slot openings, consistent with some embodiments of the present disclosure.

FIG. 2 is an exemplary illustration of a drop tray with slot openings, consistent with some embodiments of the present disclosure. As illustrated in FIG. 2, a drop tray 200 with slot openings may comprise a base with raised sidewalls and an open top. The drop tray 200 may share all of the same features as the drop tray 100 in FIG. 1. The drop tray 200 may include a base 212 (also referring to the base 112) and a plurality of upper peripheral edges 214 (also referring to the plurality of upper peripheral edges 114) positioned above and surrounding the base 212 to form an open top where the base 212 may be connected to the plurality of peripheral edges 214 by a plurality of raised sidewalls 216 extending from the base 212 to the plurality of peripheral edges 214. The plurality of raised sidewalls 216 may comprise the same first sidewall 116, second sidewall 118, third sidewall 120, fourth sidewall 122, first corner sidewall 124, second corner sidewall 126, third corner sidewall 128, and fourth corner sidewall 130 as in FIG. 1, described above.

The base 212 may include one or more openings 218 to interface or accommodate a high-chair, a footrest, a car seat, or any other functionally similar devices for children. The one or more openings 218 may be two slots approximately placed near edge 220 of base 212 and centered between edge 222 and edge 224 of base 212. A slot may be in the shape of a square, a rectangle, an oval, a circle, a triangle, a star, and/or any combination thereof.

Figure 3:
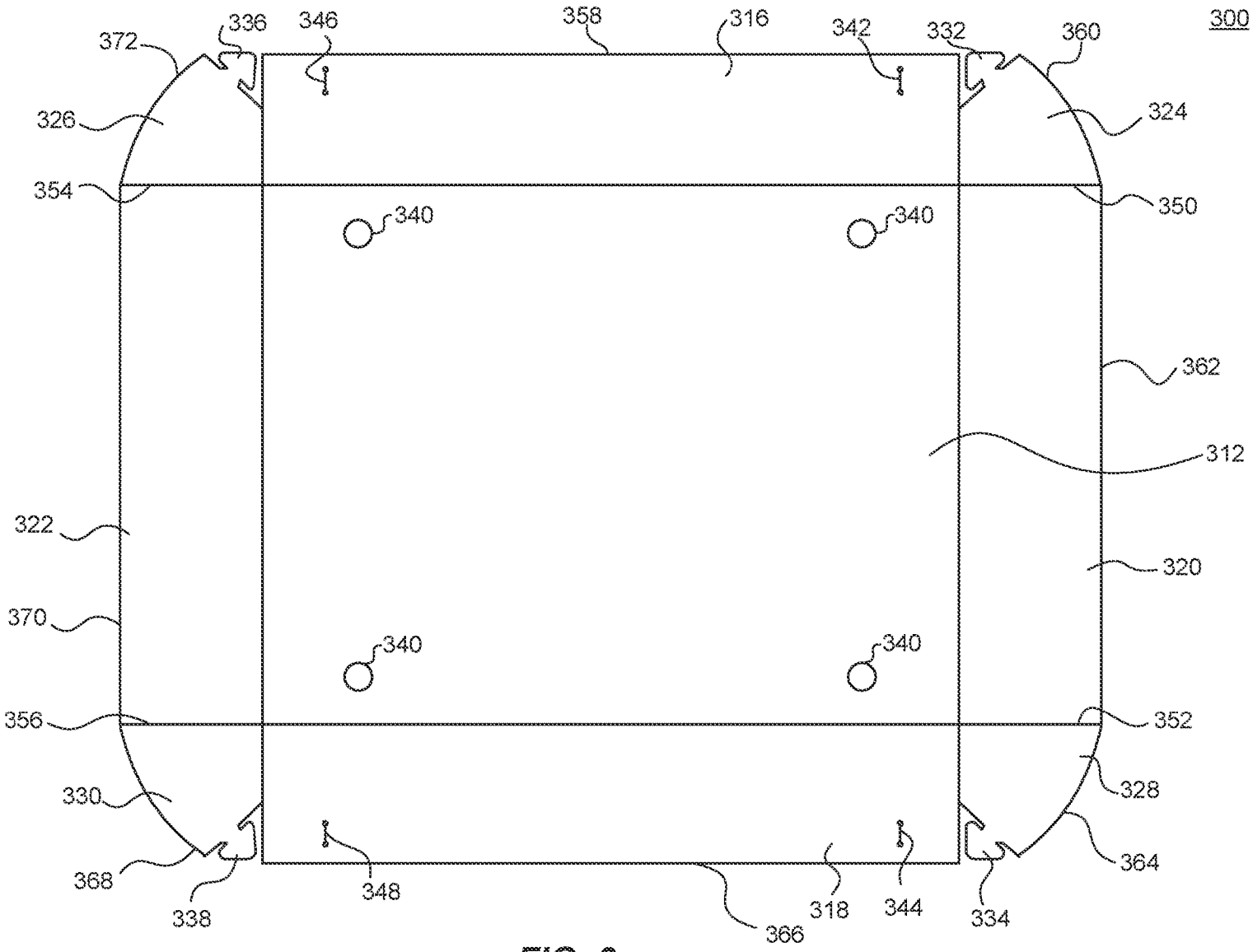
FIG. 3 is an illustration of a cut blank sheet of a drop tray with openings, consistent with some embodiments of the present disclosure.

FIG. 3 is an illustration of a cut blank sheet of a drop tray with openings, consistent with some embodiments of the present disclosure. As illustrated in FIG. 3, a drop tray 300 with openings may be in a collapsed configuration from which drop tray 100 of FIG. 1 may be assembled. The drop 300 may include a base 312 (also referring to base 112 of FIG. 1), a first sidewall 316 (also referring to the first sidewall 116 of FIG. 1), a second sidewall 318 (also referring to the second sidewall 118 of FIG. 1), a third sidewall 320 (also referring to the third sidewall 120 of FIG. 1), and a fourth sidewall 322 (also referring to the fourth sidewall 122 of FIG. 1).

Furthermore, the drop tray 300 may include a first corner sidewall 324 (also referring to the first corner sidewall 124 of FIG. 1), a second corner sidewall 326 (also referring to the second corner sidewall 126 of FIG. 1), a third corner sidewall 328 (also referring to the third corner sidewall 128 of FIG. 1), and a fourth corner sidewall 330 (also referring to the fourth corner sidewall 130 of FIG. 1). The plurality of raised sidewalls of FIG. 1 may comprise the first sidewall 316, the second sidewall 318, the third sidewall 320, the fourth sidewall 322, the first corner sidewall 324, the second corner sidewall 326, the third corner sidewall 328, and the fourth corner sidewall 330.

Moreover, the drop tray 300 may include a deformable tab clip 332 (also referring to the deformable tab clip 132 of FIG. 1) connected to the first corner sidewall 324, a deformable tab clip 334 (also referring to the deformable tab clip 134 of FIG. 1) connected to the third corner sidewall 328, a deformable tab clip 336 (also referring to the deformable tab clip 136 of FIG. 1) connected to the second corner sidewall 326, and a deformable tab clip 338 (also referring to the deformable tab clip 138 of FIG. 1) connected to the fourth corner sidewall 330.

Furthermore, the drop tray 300 may include four openings 340 on the base 312, a deformable slit opening 342 on the first sidewall 316 where the deformable slit opening 342 may be located near the deformable tab clip 332 for insertion of the deformable tab clip 332 into the deformable slit opening 342, a deformable slit opening 344 on the second sidewall 318 where the deformable slit opening 344 may be located near the deformable tab clip 334 for insertion of the deformable tab clip 334 into the deformable slit opening 344, a deformable slit opening 346 on the first sidewall 316 where the deformable slit opening 346 may be located near the deformable tab clip 336 for insertion of the deformable tab clip 336 into the deformable slit opening 346, and a deformable slit opening 348 on the second sidewall 318 where the deformable slit opening 348 may be located near the deformable tab clip 338 for insertion of the deformable tab clip 338 into the deformable slit opening 348. An opening may be in the shape of a square, a rectangle, an oval, a circle, a triangle, a star, and/or any combination thereof.

Moreover, the first corner sidewall 324 may share edge 350 with the third sidewall 320; the third corner sidewall 328 may share edge 352 with the third sidewall 320; the second corner sidewall 326 may share edge 354 with the fourth sidewall 322; the fourth corner sidewall 330 may share edge 356 with the fourth sidewall 322.

In addition, the plurality of upper peripheral edges 114 of FIG. 1 may comprise edge 358 of the first sidewall 316, edge 360 of the first corner sidewall 324, edge 362 of the third sidewall 320, edge 364 of the third corner sidewall 328, edge 366 of the second sidewall 318, edge 368 of the fourth corner sidewall 330, edge 370 of the fourth sidewall 322, and edge 372 of the second corner sidewall 326. The deformable slit opening 342 and 346 may be perpendicular to edge 358; and the deformable slit opening 344 and 348 may be perpendicular to edge 366. In another embodiment, edge 358, 360, 362, 364, 366, 368, 370, and 372 may be straight and/or curved lines. In yet another embodiment, edge 360, 364, 368, and 372 may be curved lines that may create a dish shape for the first corner sidewall 324, the second corner sidewall 326, the third corner sidewall 328 and the fourth sidewall 330 in the assembled drop tray 100 of FIG. 1 and drop tray 200 of FIG. 2.

Furthermore, the deformable slit opening 342, 344, 346, and 348 may each be shaped in the form of two parallel lines spaced apart forming an opening where a circle may connect one end of each line on one end and another circle connects the other ends of each line on the other end.

Figure 4:
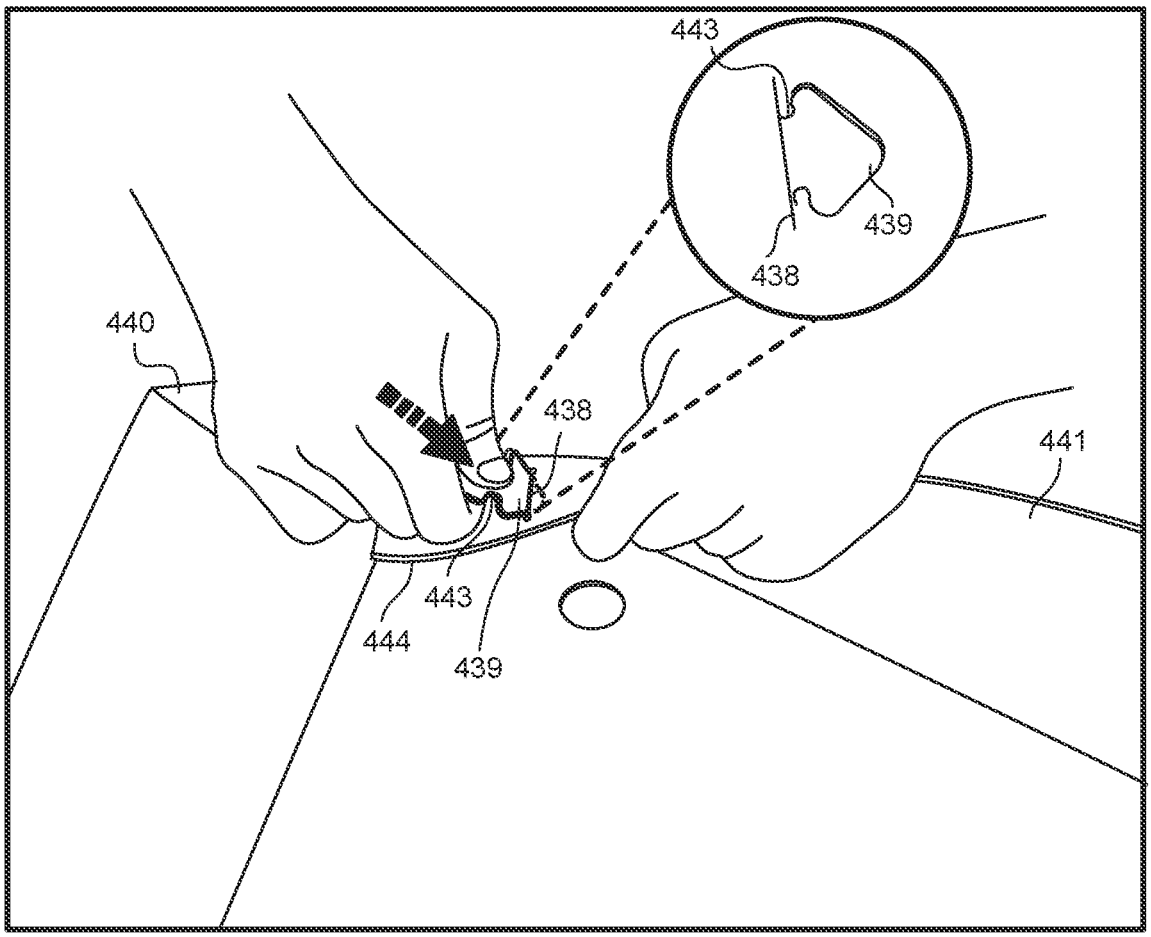
FIG. 4 is an illustration of assembling the corners of a drop tray corner, consistent with some embodiments of the present disclosure.

FIG. 4 is an illustration of assembling the corners of a drop tray corner, consistent with some embodiments of the present disclosure. As illustrated in FIG. 4, in order to assemble a drop tray 400 (also referring to drop tray 100 of FIG. 1, 200 of FIG. 2, and 300) deformable slit 438 (also referring to deformable slit 342, 344, 346, or 348 of FIG. 3) may be adapted to co-operate with a deformable tab clip 439 (also referring to deformable tab clip 332, 334, 336, or 336) adapted to drag a corner sidewall 440 (also referring to the first corner sidewall 324, the second corner sidewall 326, the third corner sidewall 328, or the fourth corner sidewall 330 of FIG. 3) behind sidewall 441 (also referring to the first sidewall 316 or the second sidewall 318 of FIG. 3). The deformable tab clip 439 may have its widest portion with a width greater than the deformable slit 438's length. The deformable tab clip 439 may be deformably passed through the deformable slit 438 where the widest portion of the deformable clip 439 may be locked in as a neck 443 of the deformable tab clip 439 may come into register with the deformable slit 438. The deformable slits 438 may be at an angle of 90 degrees from an edge 444 (also referring to edge 358 or 366 of FIG. 3) of the sidewall 441 so that the corner sidewall 440 may be parallel with the edge 444 of the sidewall 441.

Figure 5:
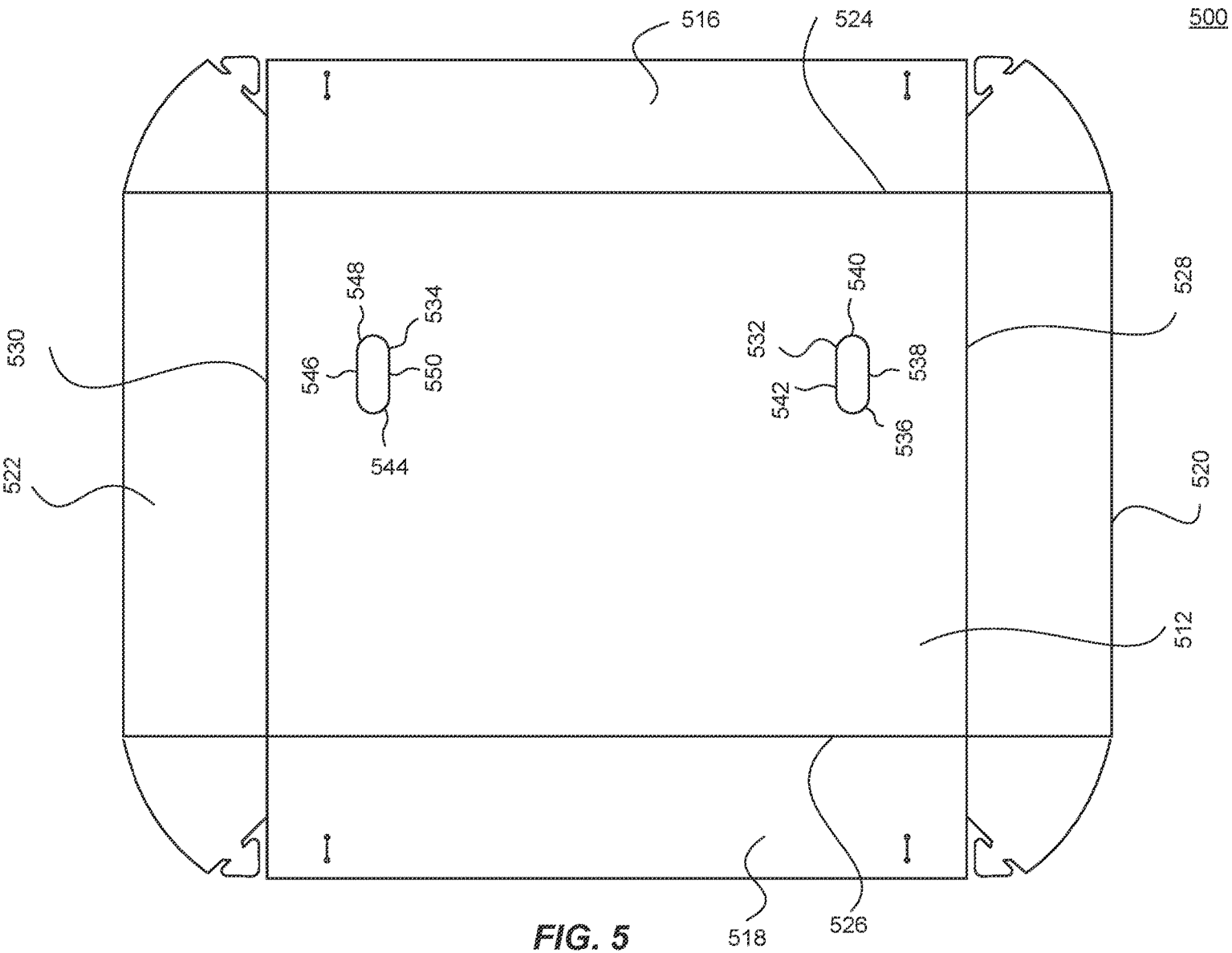
FIG. 5 is an illustration of a cut blank sheet of a drop tray with slot openings, consistent with some embodiments of the present disclosure.

FIG. 5 is an illustration of a cut blank sheet of a drop tray with slot openings, consistent with some embodiments of the present disclosure. As illustrated in FIG. 5, a drop tray 500 with slot openings may be in a collapsed configuration from which drop tray 200 of FIG. 2 may be assembled. The drop tray 500 may also share all of the same features as the drop tray 300 in FIG. 3. The drop tray 500 may include a base 512 (also referring to base 112 of FIG. 1, base 212 of FIG. 2, and base 313 of FIG. 3), a first sidewall 516 (also referring to the first sidewall 116 of FIG. 1, the first sidewall 216 of FIG. 2, and the first sidewall 316 of FIG. 3), a second sidewall 518 (also referring to the second sidewall 118 of FIG. 1, the second sidewall 218 of FIG. 2, and the second sidewall 318 of FIG. 3), a third sidewall 520 (also referring to the third sidewall 120 of FIG. 1, the third sidewall 220 of FIG. 2, and the third sidewall 318 of FIG. 3), and a fourth sidewall 522 (also referring to the fourth sidewall 122 of FIG. 1, the fourth sidewall 222 of FIG. 2, and the fourth sidewall 322 of FIG. 3).

Furthermore, base 512 may have edge 524, 526, 528, and 530. Edge 524 may be on the opposite side of edge 526; and edge 528 may be on the opposite side of edge 530. Edge 524 may be parallel to edge 526; and edge 528 may be parallel to edge 530. The first sidewall 516 may share the edge 524 with base 512; the second sidewall 518 may share the edge 526 with base 512; the third sidewall 520 may share the edge 528 with base 512; and the fourth sidewall 522 may share the edge 530 with base 512.

Moreover, base 512 may include slot opening 532 and slot opening 534 (also referring to the one or more openings 218 of FIG. 2). The slot opening 532 may include parallel edge 538 and 542 with their ends connected to semi-circle 536 and 540, respectively. The slot opening 534 may include parallel edge 546 and 550 with their ends connected to semi-circle 544 and 548 respectively. The slot opening 532 and 534 may be centered between edge 528 and edge 530. Furthermore, slot opening 532 and 534 may be biased to be positioned near edge 524 and further away from edge 526, Edge 538 and 542 of slot opening 532 may be parallel to edge 528 and perpendicular to edge 524. Edge 546 and 550 of slot opening 534 may also be parallel to edge 528 and perpendicular to edge 524. A slot opening may be in the shape of a square, a rectangle, an oval, a circle, a triangle, a star, and/or any combination thereof.

Figure 6:
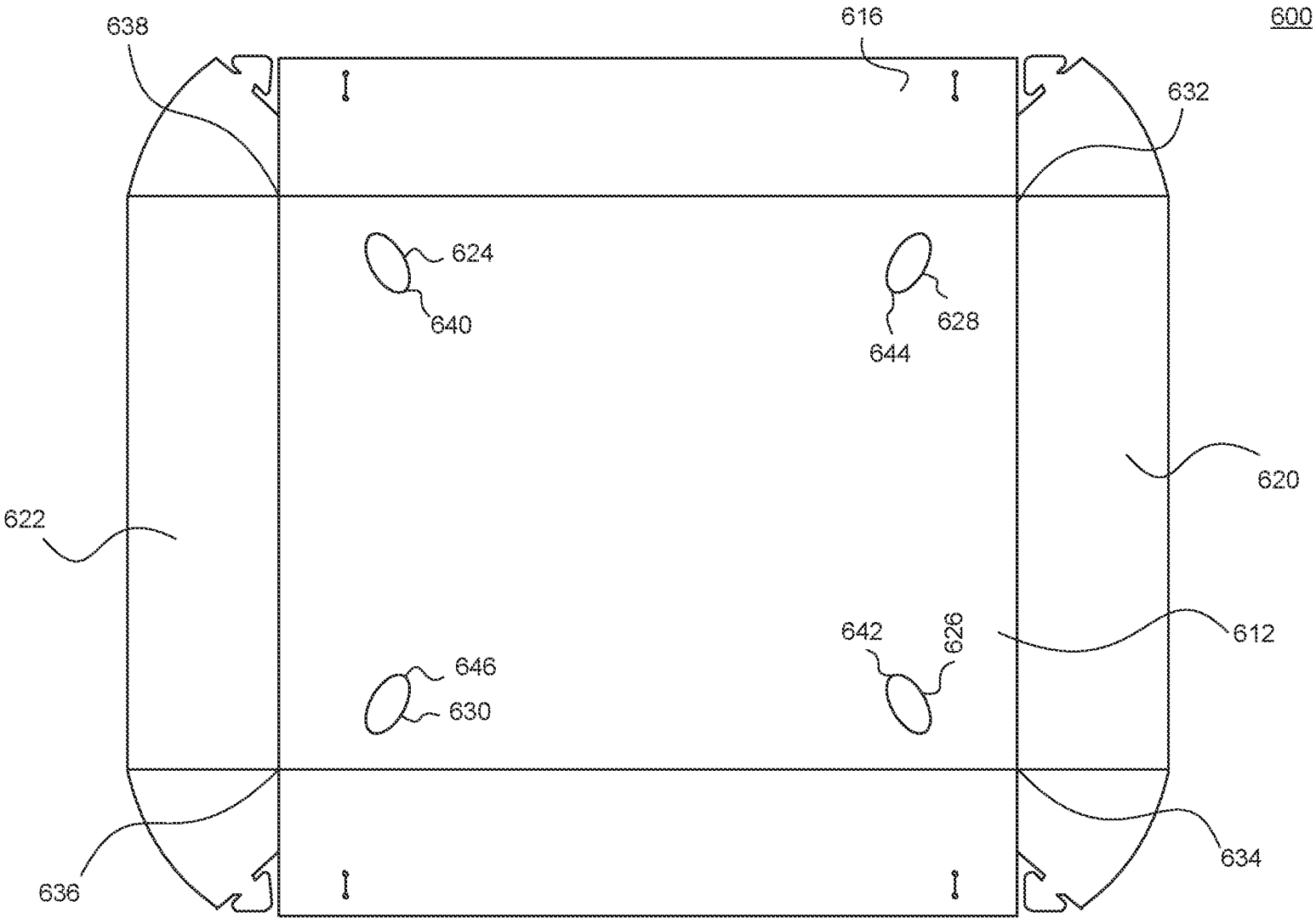
FIG. 6 is an illustration of a cut blank sheet of a drop tray with diagonal slot openings, consistent with some embodiments of the present disclosure.

FIG. 6 is an illustration of a cut blank sheet of a drop tray with diagonal slot openings, consistent with some embodiments of the present disclosure. As illustrated in FIG. 6, a drop tray 600 with diagonal slot openings may be in a collapsed configuration from which drop tray 100 of FIG. 1 may be assembled. The drop tray 600 may also share all of the same features as the drop tray 300 in FIG. 3. The drop tray 600 may include a base 612 (also referring to base 112 of FIG. 1, base 212 of FIG. 2, and base 313 of FIG. 3), a first sidewall 616 (also referring to the first sidewall 116 of FIG. 1, the first sidewall 216 of FIG. 2, and the first sidewall 316 of FIG. 3), a second sidewall 618 (also referring to the second sidewall 118 of FIG. 1, the second sidewall 218 of FIG. 2, and the second sidewall 318 of FIG. 3), a third sidewall 620 (also referring to the third sidewall 120 of FIG. 1, the third sidewall 220 of FIG. 2, and the third sidewall 318 of FIG. 3), and a fourth sidewall 622 (also referring to the fourth sidewall 122 of FIG. 1, the fourth sidewall 222 of FIG. 2, and the fourth sidewall 322 of FIG. 3).

Furthermore, base 612 may include diagonal slot opening 624, 626, 628, and 630. The diagonal slot opening 624 may be near corner 638 of base 612; the diagonal slot opening 626 may be near corner 634 of base 612; the diagonal slot opening 628 may be near corner 632 of base 612; and the diagonal slot opening 630 may be near corner 636 of base 612. Moreover, the diagonal slot opening 624 may have a vertex 640, and the diagonal slot opening 626 may have a vertex 642 where vertex 640 and vertex 642 may form an imaginary line that may be parallel to the imaginary line connecting corner 638 and corner 634. In addition, the diagonal slot opening 628 may have a vertex 644, and the diagonal slot opening 630 may have a vertex 646 where vertex 644 and vertex 646 may form an imaginary line that may be parallel or aligned with the imaginary line connecting corner 632 and corner 636. A slot opening may be in the shape of a square, a rectangle, an oval, a circle, a triangle, a star, and/or any combination thereof.

Figure 7:
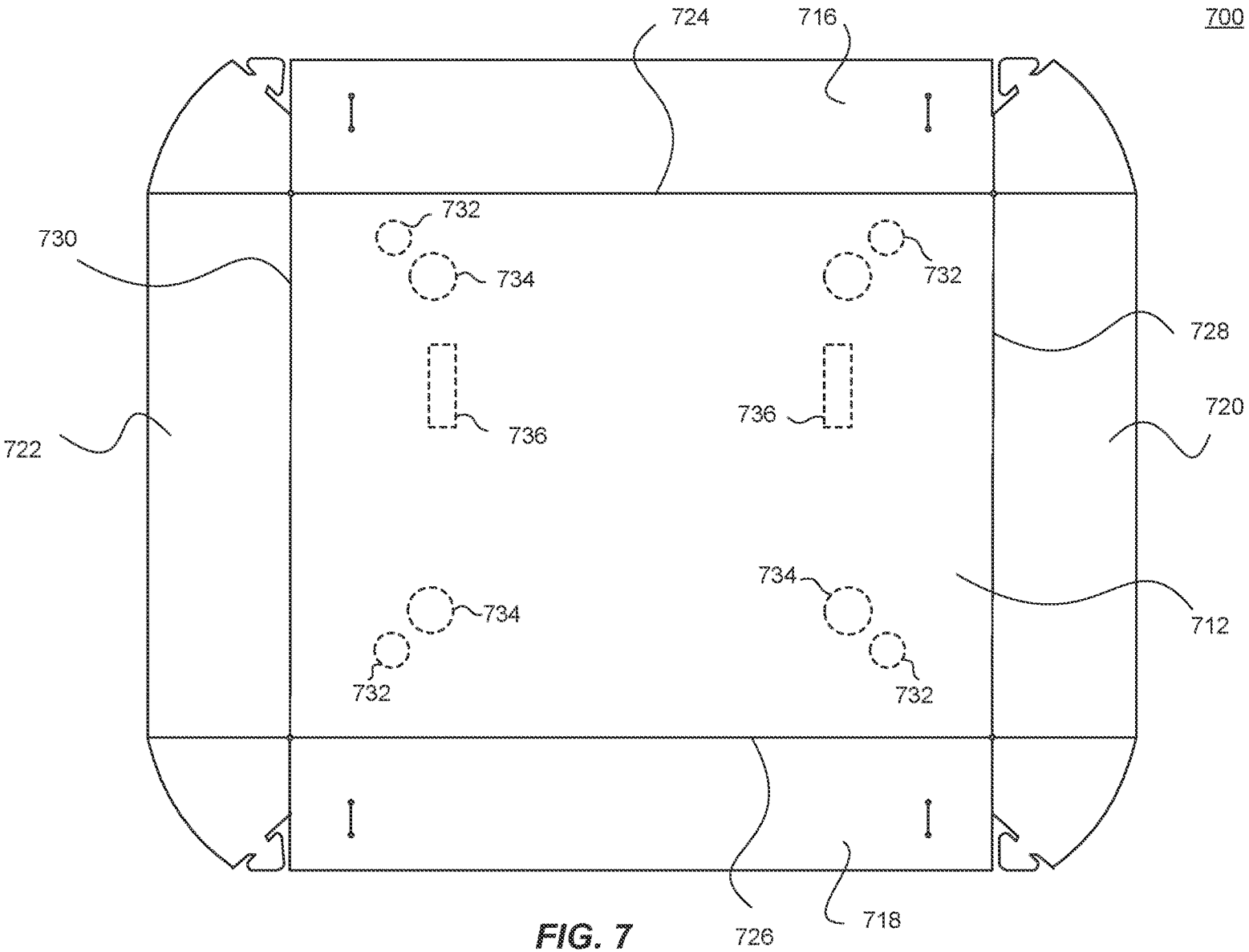
FIG. 7 is an illustration of a cut blank sheet of a drop tray with universal openings, consistent with some embodiments of the present disclosure.

FIG. 7 is an illustration of a cut blank sheet of op tray with universal openings, consistent with some embodiments of the present disclosure. As illustrated in FIG. 7, a drop tray 700 with universal openings may be in a collapsed configuration from which drop tray 100 of FIG. 1 may be assembled. The drop tray 700 may also share of the same features as the drop tray 300 in FIG. 3. The drop tray 700 may include a base 712 (also referring to base 112 of FIG. 1, base 212 of FIG. 2, and base 313 of FIG. 3), a first sidewall 616 (also referring to the first sidewall 16 of FIG. 1, the first sidewall 216 of FIG. 2, and the first sidewall 316 of FIG. 3), a second sidewall 718 (also referring to the second sidewall 118 of FIG. 1, the second sidewall 218 of FIG. 2, and the second sidewall 318 of FIG. 3), a third sidewall 720 (also referring to the third sidewall 120 of FIG. 1, the third sidewall 220 of FIG. 2, and the third sidewall 318 of FIG. 3), and a fourth sidewall 722 (also referring to the fourth sidewall 122 of FIG. 1, the fourth sidewall 222 of FIG. 2, and the fourth sidewall 322 of FIG. 3).

Furthermore, base 712 may include an edge 724 that may be shared with the first sidewall 716, an edge 726 that may be shared with the second sidewall 718, an edge 728 that may be shared with the third sidewall 728, and an edge 730 that may be shared with the fourth sidewall 722. Moreover, base 712 may include universal openings. The universal openings may allow drop tray 700 to fit the interface for a variety of configurations for different high-chairs, footrests, car seats, or any other functionally similar devices for children.

The universal openings may comprise four first small circular openings 732, four large circular openings 734, and a pair consisting of two rectangular openings 736. The universal openings may be of various shapes such as ovals, squares, triangles, trapezoids, stars, and/or any other combination thereof. Furthermore, the universal openings may be centered between edge 728 and 730. Furthermore, the universal openings may be biased to be located near edge 724 and away from edge 726.

Figure 8:
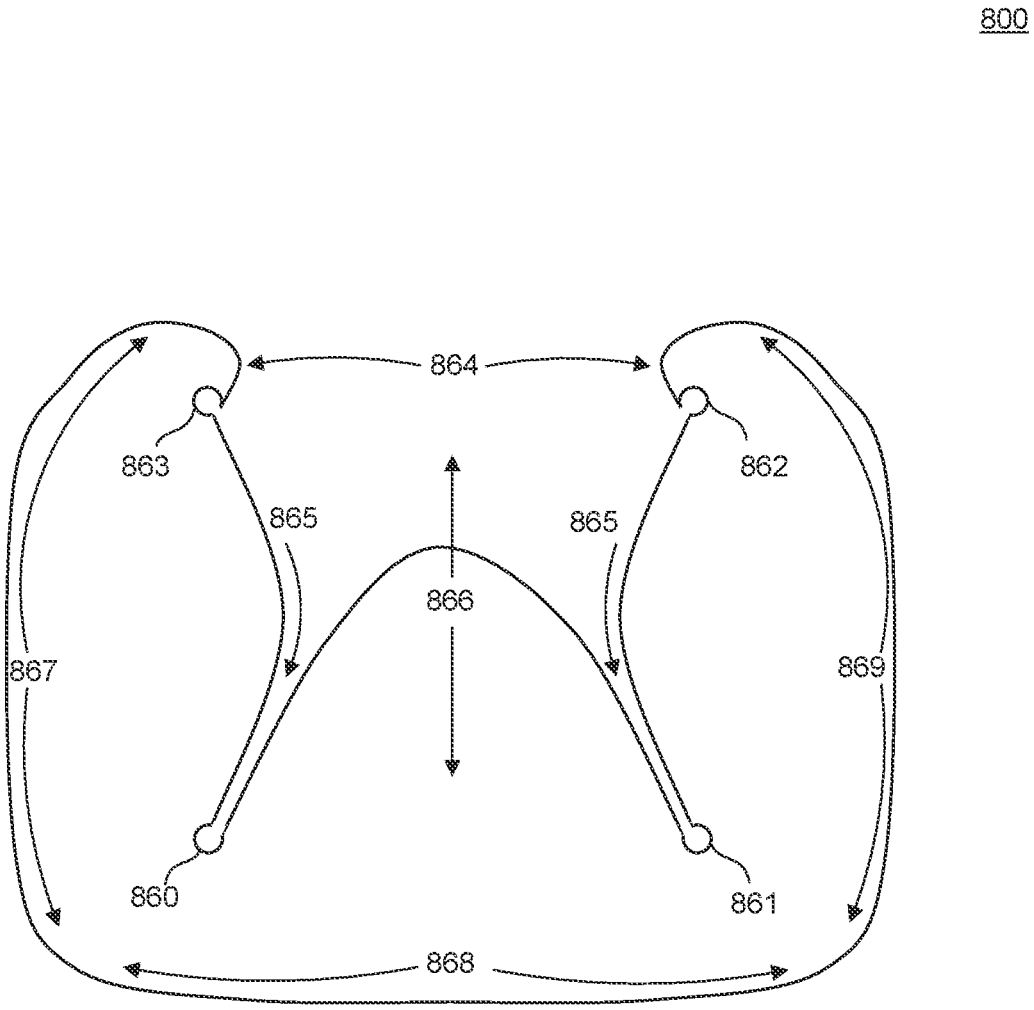
FIG. 8 is an illustration a cut blank sheet of a drop tray that may be fitted without removing the legs of a high-chair, consistent with some embodiments of the present disclosure.

FIG. 8 is an illustration of a cut blank sheet of a drop tray that may be fitted without removing the legs of a high-chair, consistent with some embodiments of the present disclosure. As illustrated in FIG. 8, a drop tray 800 may be in a collapsed configuration from which drop tray 100 of FIG. 1. Furthermore, the drop tray 800 may be assembled to a high-chair without removing the legs of the high-chair. The drop tray 800 may have holes 860, 861, 862, and 863 that may be in the same positions as drop tray 300 of FIG. 3. The holes 860-863 may be in the shape of circles, ovals, squares, rectangles, and/or any combination thereof.

Furthermore, passage 864 and 865 may allow for the legs of a high-chair to be inserted to drop tray 800 where a clipping action fitted in holes 860-863 secures the drop tray 800 under the high-chair. Region 866 may be under the high-chair seat to catch food, spills, plates, and/or utensils. Moreover, the periphery sidewalls or margins 867, 868, and 869 may form a dished shape when the clipping action fitted in holes 860-863 may secure the drop tray 800 under of the high-chair and above the floor where clipping action fitted in holes 860-863 are performed on one or more legs of the high-chair without requiring disassembling the one or more legs from the high-chair.

Figure 9:
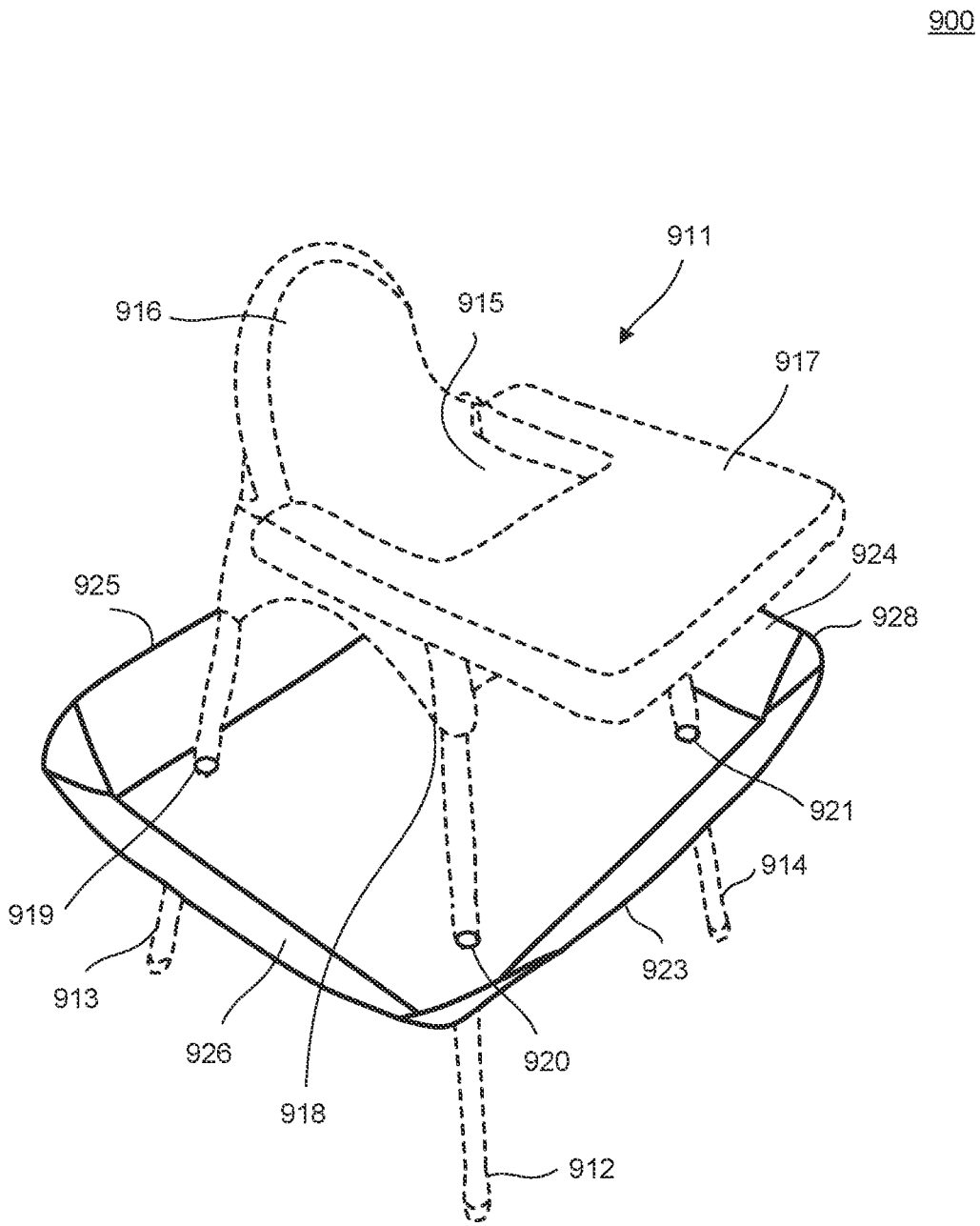
FIG. 9 is an illustration of a molded or thermoformed drop tray fitted to a high-chair, consistent with embodiments of the present disclosure.

FIG. 9 is an illustration of a molded or thermoformed drop tray fitted to a high-chair, consistent with embodiments of the present disclosure. As illustrated in FIG. 9, drop tray 900 may be the drop tray 100 of FIG. 1, the drop tray 200 of FIG. 2, the assembled drop tray 300 of FIG. 3, the assembled drop tray 600 of FIG. 6, the assembled drop tray 700 of FIG. 7, and the assembled drop tray 800 of FIG. 8. The high-chair 911 may have four splayed legs 912, 913, and 914 (the fourth splayed leg is not shown).

The high-chair may have a high-chair seat 915, a backrest 916 and a table 917. In relation to exemplary leg 912, each leg may fit into a socket 918. The socket 918 may be threaded or have a push button release so the splayed legs may be removed or separated from the seat.

Upon removal or separation of the splayed legs, the drop tray 900 may fitted to the high-chair. Holes 919, 920, 921 and 922 (also referring to one or more openings 140 of FIG. 1, one or more openings 218 of FIG. 2, four openings 340 of FIG. 3, diagonal slot opening 624, 626, 628, and 630 of FIG. 6, the universal openings of FIG. 7, or holes 860, 861, 862, and 863 of FIG. 8) in the drop tray 900 may be sized to match the high-chair's splayed legs. The splayed legs may be removed or separated from the seat, may be fed through holes 919, 920, 921, and 922 (not shown), and the high-chair and the legs may be reassembled where the drop tray 900 may be under the high-chair seat and above the floor. Drop tray 900 may be a simple and efficient design that may provide for a firm fit as there may be no complicated attachments to the high-chair that may fail. The splayed legs and the holes 919, 920, 921, and 922 may be positioned such the drop tray 900's height may be set in a wedge fashion. The drop tray 900 may be positioned high enough to provide a footrest for a child. The drop tray 900 outer periphery (also referring to the base and the plurality of raised sidewalls in FIG. 1, FIG. 2, FIG. 3, FIG. 6, FIG. 7, and periphery sidewalls or margins in FIG. 8) when installed should be larger than imaginary cone, pyramid, cube, or volume determined by the reach of an infant to increase the likelihood of a high rate of capture food or liquid spills, plates, and/or utensils. Most food may fall from the sides of the high-chair. In one embodiment, the drop tray 900 may have an even margin (also referring to the base and the plurality of raised sidewalls in FIG. 1, FIG. 2, FIG. 3, FIG. 6, FIG. 7, and periphery sidewalls or margins in FIG. 8) to catch food, spills, plates, and/or utensils around the chair, or the drop tray 900 may be biased to have more margin to catch food, spills, plates, and/or utensils around the high-chair seat 915 and the table 917. The lower the drop tray 900 may be positioned, the wider the margin to catch food, spills, plates, and/or utensils. For example, the drop tray may be about 200 mm below the high-chair's high-chair seat 915.

In one embodiment, the high-chair 911 may have one or more legs that may be separated from the high-chair 911.

In another embodiment, the drop tray 900 may be affixed to the four splayed legs 912, 913, and 914 (the fourth splayed leg is not shown) where the drop tray 900 may be integral to the high-chair 911 in that the four splayed legs and the drop tray 900 may not be separated. The drop tray 900 being integral with the high-chair 911 may mean that the drop tray 900 and the four splayed legs may be indivisible, or the drop tray 900 may be pre-formed with the four splayed legs of the high-chair 911 and/or the high-chair 911 where the four splayed legs of the high-chair 911 and/or the high-chair may be made from the same material.

In another embodiment, the high-chair 911 may have one or more legs that may be affixed to the drop tray 900 where the drop tray 900 may be integral to the high-chair 911 in that the one or more legs and the drop tray 900 may not be separated. The drop tray 900 being integral with the high-chair 911 may mean that the drop tray 900 and the one or more legs may be indivisible, or the drop tray 900 may be pre-formed with the one or more legs of the high-chair 911 and/or the high-chair 911 where the one or more legs of the high-chair 911 and/or the high-chair may be made from the same material.

In yet another embodiment, the range of the margin to catch food or liquid spills, plates, and/or utensils may be optimised by having a generally dished or curved configuration. In yet another embodiment, the sides of the drop tray 900 or margin (also referring to the plurality of raised sidewalls in FIG. 1, FIG. 2, FIG. 3, FIG. 6, FIG. 7, and periphery sidewalls or margins in FIG. 8) may be at between 10 to 90 degrees from a horizontal axis parallel to the base 927 of the drop tray 900. The angle of the sides of the drop tray 900 may vary around the high-chair where the back of the high-chair may not require an angle, and the front and sides of the high-chair may need an angle for the sides of the drop tray 900. Also the sides 923, 924, 925 and 926 may form a dish about the base 927, and the sides 923, 924, 925, and 926 may serve additional function when using a thin flexible plastic sheet to form the drop tray 900. In this form the drop tray 900 may be manually manipulated usefully. For example, a corner 928 (also referring to first corner sidewalls, second corner sidewalls, third corner sidewalls, or fourth corner sidewall of FIG. 1, FIG. 2, FIG. 3, FIG. 7, and the periphery sidewalls or margins in FIG. 8) may be pulled down to create an effective pouring spout for liquids caught in the drop tray 900. The sides 923, 924, 925 and 926 of the drop tray 900 may be pulled down likewise, to aid removal of food or cleaning. Any downward pulling on the drop tray 900 may not damage the drop tray 900 because the sides 923, 924, 925 and 926 will spring back. In one embodiment, the drop tray 900 material may be a 1.2 mm food safe polypropylene but other material may be used.

In another embodiment, drop tray 900 may contain a drainage hole not located on holes 919, 920, 921, and 922. The drainage hole may have a plug that may be removed to pour spills, liquids, and/or food through the drainage hole to pour into a trashcan.

While the dished configuration on may provide an easy way to clean food trapped on the corner 928, drop tray 900 may be cleaned by disassembling it in situ into its cut blank sheet form, and then after drying the drop tray 900 may be reassembled.

In other embodiments, the drop tray 900 in a cut blank sheet form may be placed in a dishwasher. In yet other embodiments, the drop tray 900 may be two or more pieces constructed together to fit around a high-chair, a footrest, a car seat, or any other functionally similar devices for children.

Figure 10A:
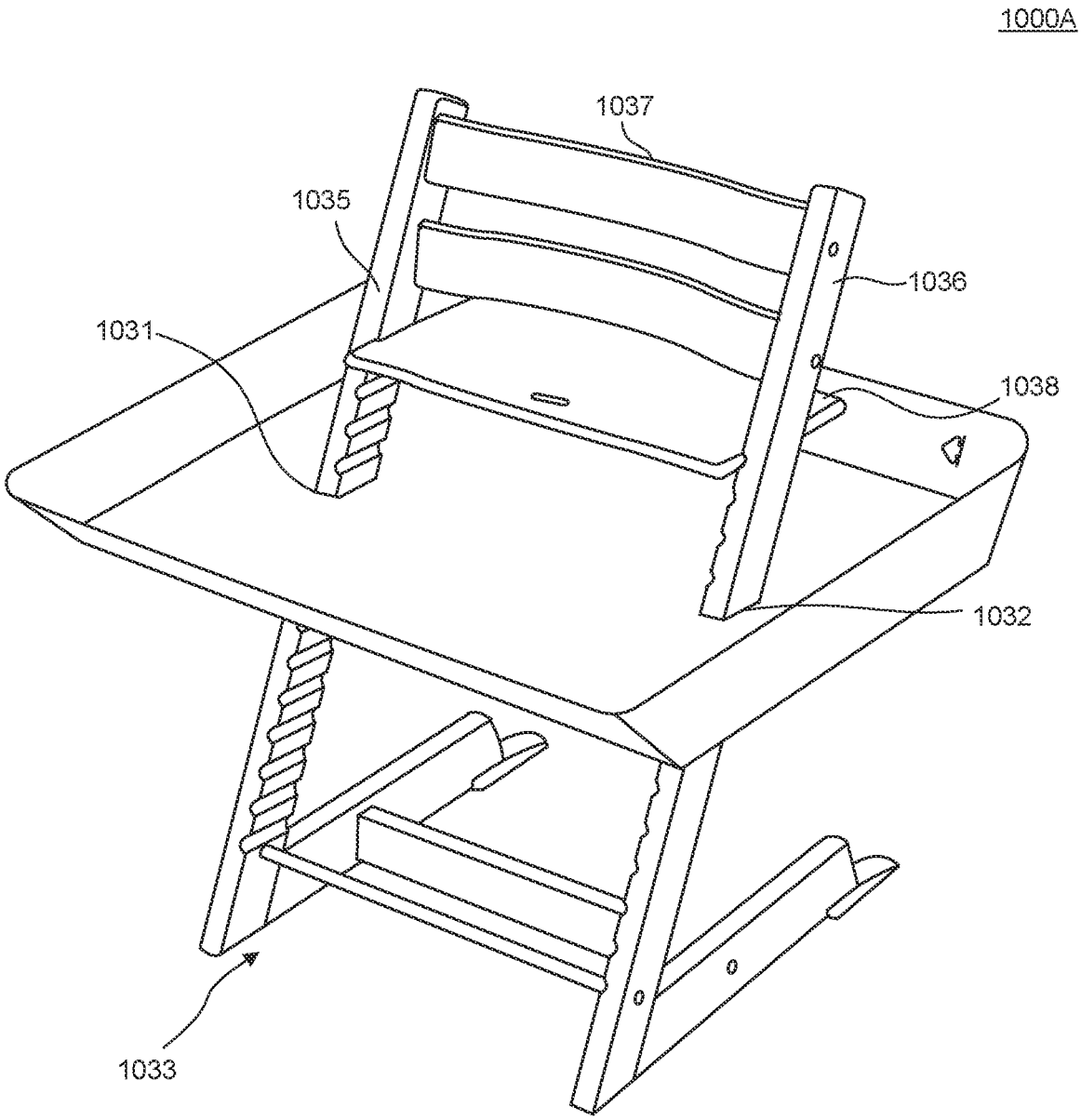
FIGS. 10A and 10B are illustrations of a drop tray on a two legged high-chair, consistent with embodiments of the present disclosure.

FIG. 10A is an illustration of a drop a two legged high-chair, consistent with embodiments of the present disclosure. As illustrated in FIG. 10A, the drop tray 1000A may have holes 1031 and 1032 (also referring to the one or more openings 140 of FIG. 2 and the slot opening 532 and 534 of FIG. 5) to accommodate the squared leg 1035 and 1036 of high-chair 1037. The drop tray 1000A may be positioned on the high-chair 1037 below the seat 1038 and above the floor 1033.

Figure 10B:
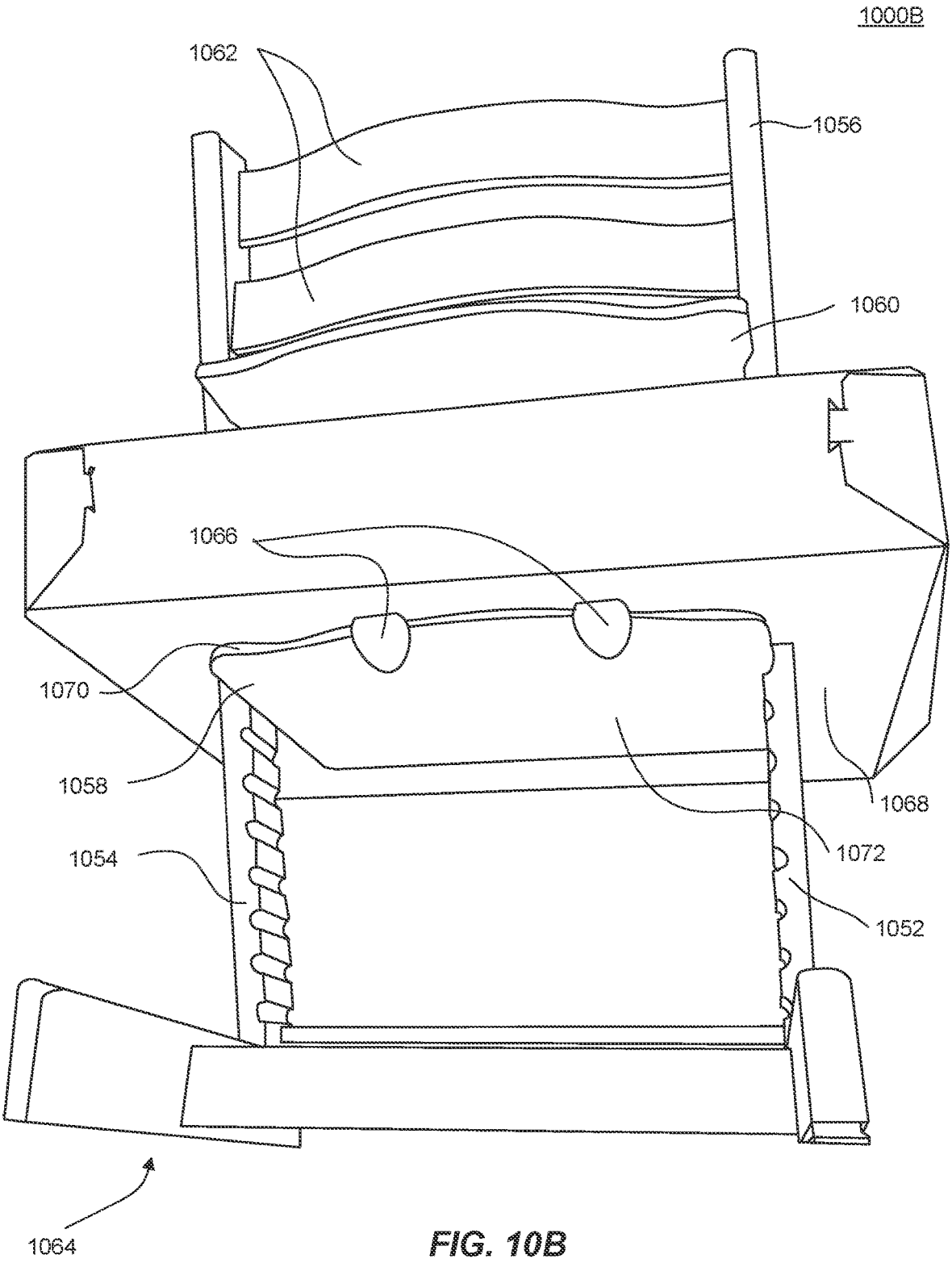

FIG. 10B is an illustration of a rear view of a drop tray on a two legged high-chair clipped onto a footrest of the high-chair, consistent with embodiments of the present disclosure. As illustrated in FIG. 10B, the rear view of FIG. 10A may be shown. The drop tray 1000B (also referring to the drop tray 1000A of FIG. 10A, drop tray 200 of FIG. 2, and drop tray 500 of FIG. 5) may accommodate the squared leg 1052 and 1054 of high-chair 1056. The high-chair 1056 may include a footrest 1058, a seat 1060, and a back rest 1062. The footrest 1058 may be positioned above the floor 1064 and below the seat 1060, The drop tray 1000B may be positioned below the seat 1060 on the high-chair 1056 and above the floor 1064. The drop tray 1000B may positioned to rest on top of the footrest 1058. The drop tray 1000B may include one or more tabs or clips 1066 connected to a base 1068 of the drop tray 1000B. The one or more tabs or clips 1066 may contact or interface with a rear surface 1070 (and/or be side and from surfaces) and/or base 1072 of the footrest 1058 to prevent the drop tray 1000B from sliding off the footrest 1058. The one or more tabs or clips 1066 may be in the shape of a space, a square, a rectangle, a triangle, a hook, and/or any other shapes that may serve the function of contacting or interfacing with the rear surface 1070 and/or base 1072 of the footrest 1058.

Figure 11:
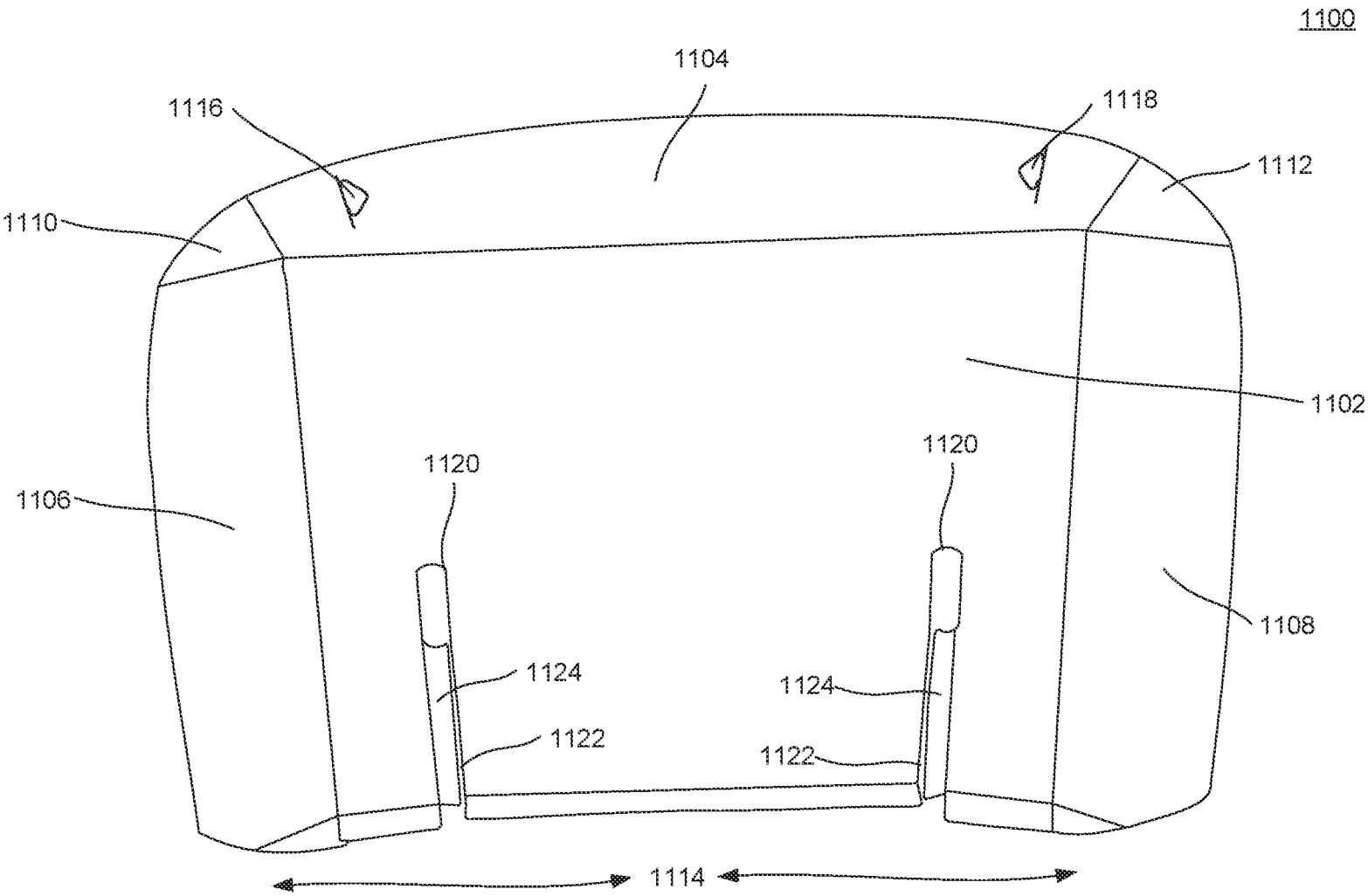
FIG. 11 is an illustration of a drop tray for a two legged high-chair with an open back with two slots for sliding onto a chair, consistent with embodiments of the present disclosure.

FIG. 11 is an illustration of drop tray for a two legged high-chair with an open back with two slots for sliding onto a chair, consistent with embodiments of the present disclosure. As illustrated in FIG. 11 a drop tray 1100 (also referring to the drop tray 100 of FIG. 1, the drop tray 200 of FIG. 2, the drop tray 300 of FIG. 3, the drop tray 500 of FIG. 5, the drop tray 600 of FIG. 6, the drop tray 700 of FIG. 7, the drop tray 900 of FIG. 9, the drop tray 1000A of FIG. 10A, and the drop tray 1000B of FIG. 10B) may include a base 1102, a front sidewall 1104, a left sidewall 1106, a right sidewall 1108, a left-front corner sidewall 1110, and a right-front corner sidewall 1112. The drop tray 1100 may not have a rear sidewall, a left-rear sidewall, or a right-rear sidewall at the rear area 1114 of the drop tray 1100. The left-front corner sidewall 1110 may include a deformable tab clip 1116 that may be inserted into a slit of the front sidewall 1104. The right-front corner sidewall 1112 may include a deformable tab clip 1118 that may be inserted into a slit of the front sidewall 1104. The deformable tab clip 1116 may connect the left sidewall 1106 and the left-front corner sidewall 1110 to the front sidewall 1104. The deformable tab clip 1118 may connect the right sidewall 1108 and the right-front corner sidewall 1112 to the front sidewall 1104. The base 1102 may be connected to the front sidewall 1104, the left sidewall 1106, and the right sidewall 1108. The base 1102 may include one or more slots 1120 where each one or more slots 1120 may include a slit opening 1122 that may extend from the one or more slots 1120 to the rear area 1114. The slit opening 1122 may allow the drop tray 1100 to slide and fit onto a high-chair, one or more legs of a high-chair, a footrest, a bumper seat, a car seat, and/or chair without the need to remove any legs. For example, drop tray 1100 may be the drop tray 1000B in FIG. 10B where the drop tray 1100 may be placed on top of footrest 1058. Rear area 1114 of the drop tray 1100 may be facing the rear of the high-chair 1056 (referring to FIG. 10B) so that the left sidewall 1106, the right sidewall 1108, the left-front corner sidewall 1110, the right-front corner sidewall 1112, and the front sidewall 1104 may surround and extend beyond the seat 1060 (referring to FIG. 10B). The drop tray 1100 may also include one or more tabs or clips 1066 (referring to FIG. 10B). The one or more tabs or clips 1066 may be connected to the base 1102 (referring to FIG. 10B) of the drop tray 1100. The one or more tabs or clips 1066 may contact or interface with a rear surface 1070 (and/or the side and front surfaces) and/or base 1072 of the footrest 1058 (referring to FIG. 10B) to prevent the drop tray 1100 from sliding off the footrest 1058. Each of the one or more slots 1120 may include foldings 1124 that may be attached to the base 1102 and the slit opening 1122 behind the one or more slots 1120. Foldings 1124 may secure the drop tray 1100 to one or more legs, a footrest, high-chair, a bumper seat, a car seat, and/or a chair.

In one embodiment, drop tray 1100 may be thermoformed to be a single continuous material without the need of deformable tab clip 1116 because the left sidewall 1106, the base 1102, the right sidewall 1108, the left-front corner sidewall 1110, the right-front corner sidewall 1112, and the front sidewall 1104 may be one continuous material. Furthermore, the drop tray 1100 may be thermoformed to include the one or more tabs or clips 1066 on the base 1102.

The descriptions of the various embodiments of the present disclosure have been presented for purposes of illustration and are not intended to be exhaustive or limiting. Multiple modifications and variations of the disclosed embodiments will be apparent to those of ordinary skill in the art, without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Certain features of the present disclosure, which are, for clarity, described in the context of separate embodiments, may also be combined in a single embodiment. Conversely, various features of the invention, which are, for brevity, described in the context of a single embodiment, may also be provided separately or in any suitable sub-combination or as suitable in any other described embodiment of the disclosure. Certain features described in the context of various embodiments are not to be considered essential features of those embodiments, unless the embodiment is inoperative without those elements.

What is claimed is:

1. An apparatus for catching spills, utensils, toys, or plates, the apparatus comprising:

a drop tray; a high-chair including one or more legs and a high-chair seat;

the one or more legs is connected to the high-chair;

the one or more legs raising the high-chair seat above a floor;

the drop tray is disposed above the floor and underneath the high-chair seat;

the drop tray interfaces with the one or more legs of the high-chair;

wherein the drop tray further comprises:

an upper peripheral edge above and surrounding a base;

one or more sidewalls, each sidewall extending between the upper peripheral edge and the base, wherein the base includes at least a first edge and a second edge, the first edge being shared with a first sidewall, and the second edge being shared with a second sidewall; and at least one opening in the base between the first edge and the second edge;

wherein the at least one opening interfaces with the one or more legs of the high-chair.

2. The apparatus of claim 1, wherein a surface area of the base is wider than the high-chair seat.

3. The apparatus of claim 1, wherein the base is biased relative to the one or more legs of the high-chair so at least one of the one or more sidewalls covers at least one of a front side, a right side, or a left side underneath the high-chair seat.

4. The apparatus of claim 1, wherein the base is centered relative to the one or more legs of the high-chair so at least one of the one or more sidewalls covers at least one of a rear-side, a right side, a left side, or a front side underneath the high-chair seat.

5. The apparatus of claim 3, wherein at least one of the one or more sidewalls of the drop tray extends beyond at least one of the front side, the right side, or the left side underneath the high-chair seat.

6. The apparatus of claim 4, wherein at least one of the one or more sidewalls of the drop tray extends beyond at least one of the rear side, the right side, the left side, or the front side underneath the high-chair seat.

7. The apparatus of claim 1, wherein the drop tray is made of plastics.

8. The apparatus of claim 1, wherein at least one of the one or more sidewalls is deformable and springs back to an operative position.

9. The apparatus of claim 1, wherein the base of drop tray includes one or more openings to attach to the one or more legs of the high-chair.

10. The apparatus of claim 9, wherein the one or more openings are universal openings interfacing with different configurations of the one or more legs of the high-chair.

11. The apparatus of claim 1, wherein the base is inseparable from the one or more legs of the high-chair.

12. The apparatus of claim 1, wherein the base removably interfaces with the one or more legs of the high-chair.

13. The apparatus of claim 2, wherein the surface area of the base includes the one or more openings with a local surface area raised above and connected to the surface of the base interfacing with the one or more legs of the high-chair.

14. A method for catching spills, utensils, toys, or plates from a high-chair, the method comprising:

separating one or more legs from a high-chair wherein the high-chair includes a high-chair seat raised above a floor;

inserting the one or more legs of the high-chair into one or more openings on a base of a drop tray wherein the drop tray comprises:

an upper peripheral edge above and surrounding the base; and one or more sidewalls, each sidewall extending between the upper peripheral edge and the base, wherein the base includes at least a first edge and a second edge, the first edge being shared with a first sidewall, and the second edge being shared with a second sidewall; and at least one opening in the base between the first edge and the second edge, wherein the at least one opening interfaces with the one or more legs of the high-chair;

reattaching the one or more legs to the high-chair; and positioning the drop tray above the floor and underneath the high-chair seat.

15. The method of claim 14, wherein a surface area of the base is wider than the high-chair seat.

16. The method of claim 14, wherein the one or more openings of the base are biased relative to the one or more legs of the high-chair so at least one of the one or more sidewalls covers at least one of a front side, a right side, or a left side underneath the high-chair seat.

17. The method of claim 14, wherein the one or more openings of the base are centered relative to the one or more legs of the high-chair so at least one of the one or more sidewalls covers at least one of a rear-side, a right side, a left side, or a front side underneath the high-chair seat.

18. The method of claim 16, wherein at least one of the one or more sidewalls of the drop tray extends beyond at least one of the front side, the right side, or the left side underneath the high-chair seat.

19. The method of claim 17, wherein at least one of the one or more sidewalls of the drop tray extends beyond at least one of the rear side, the right side, the left side, or the front side underneath the high-chair seat.

20. The method of claim 14, wherein the drop tray is made of plastics.

21. The method of claim 14, wherein at least one of the one or more sidewalls is deformable and springs back to an operative position.

22. The method of claim 14, wherein the one or more openings are universal openings interfacing with different configurations of the one or more legs of the high-chair.

* * * * *